United States Patent [19]

Hampshire

[11] 4,449,779

[45] May 22, 1984

[54] ELECTRICAL CONNECTOR

[76] Inventor: Michael J. Hampshire, 792 Halifax Rd., Liversedge, West Yorkshire, England

[21] Appl. No.: 421,102

[22] Filed: Sep. 22, 1982

Related U.S. Application Data

[63] Continuation of Ser. No. 152,028, May 21, 1980, abandoned.

[30] Foreign Application Priority Data

May 23, 1979 [GB] United Kingdom ..... 7917909

[51] Int. Cl.[3] ..... H01R 17/06

[52] U.S. Cl. ..... 339/177 R; 29/863

[58] Field of Search ..... 339/177 R, 177 E, 276 T; 29/863

[56] References Cited

U.S. PATENT DOCUMENTS

| | | | |
|---|---|---|---|
| 3,406,373 | 10/1968 | Forney | 339/177 R X |
| 3,474,385 | 10/1969 | Cefarelli et al. | 339/177 R X |
| 3,742,425 | 6/1973 | Peltola et al. | 339/177 R X |
| 3,980,382 | 9/1976 | Reeder | 339/177 R |
| 3,990,765 | 11/1976 | Hill | 339/177 R |
| 4,243,290 | 1/1981 | Williams | 339/177 R X |

FOREIGN PATENT DOCUMENTS

| | | | |
|---|---|---|---|
| 1312525 | 11/1962 | France | 339/177 R |
| 1467949 | 12/1966 | France | 339/177 R |

*Primary Examiner*—Eugene F. Desmond

*Attorney, Agent, or Firm*—Fleit, Jacobson, Cohn & Price

[57] ABSTRACT

A connector for a coaxial cable comprises a single stamping having four equally spaced branches 1 to 4 and defining a central aperture 5. Each branch 1 to 4 has spring clip portions 6 at its free end and wing portions 8. To attach the connector the outer conductor of the cable, which consists of a plurality of parallel strands, is stripped of insulation. The strands revealed are split into four groups 11 which are laid in the four branches 1 to 4 and the wing portions 8 closed over them while the central conductor 12 of the cable is pushed through the aperture 5. The branches 1 to 4 are then folded through 90° so that their end edges form the sides of a square and their spring clip portions 6 can receive the four spades of a complementary connector part which surround a central socket for the reception of the central conductor 12. The connector may have more or less than four branches and the branches may be individual connectors.

13 Claims, 3 Drawing Figures

ELECTRICAL CONNECTOR

This is a continuation of application Ser. No. 152,028 filed May 21, 1980, now abandoned.

The present invention relates to an electrical connector.

The connector is particularly intended for a coaxial cable of the type having an outer conductor formed of a plurality of parallel strands surrounding a central conductor covered with an insulating sheath.

According to one aspect of the present invention there is provided an electrical connector comprising a plurality of first connector parts each adapted to receive and be connected to one of a number of component groups into which the individual conductors of the outer sheath of a coaxial cable are split and a plurality of second connector parts complementary to the first connector part and surrounding a connector for the central conductor of the coaxial cable.

A preferred embodiment of the invention may comprise any one or more of the following advantageous features:

(a) There are three first connector parts and three second connector parts.

(b) Each of the three first and second parts of (a) are arranged around the sides of a triangle.

(c) There are four first connector parts and four second connector parts.

(d) Each of the four first and second parts of (c) are arranged around the sides of a square.

(e) The first connector parts are formed by a single stamping.

(f) The single stamping of (e) defines a central aperture through which, in use, the central conductor of the coaxial cable extends.

(g) Each first connector part comprises spring clip portions to retain corresponding second connector parts.

(h) Each first connector part comprises wings which may, in use, be folded over a corresponding group of conductors.

According to another aspect of the present invention, there is provided a method of connecting a coaxial cable having a sheath comprised of a plurality of parallel extending conductors comprising the steps of splitting the conductors into a plurality of groups, advancing the groups to the respective connector parts of a connector, positively connecting the connector parts to the respective groups and bending the parts so that they extend substantially parallel to the central conductor of the cable.

In order that the present invention may be more clearly understood, one embodiment thereof will now be described, by way of example, with reference to the accompanying drawings, in which.

Figure 1:
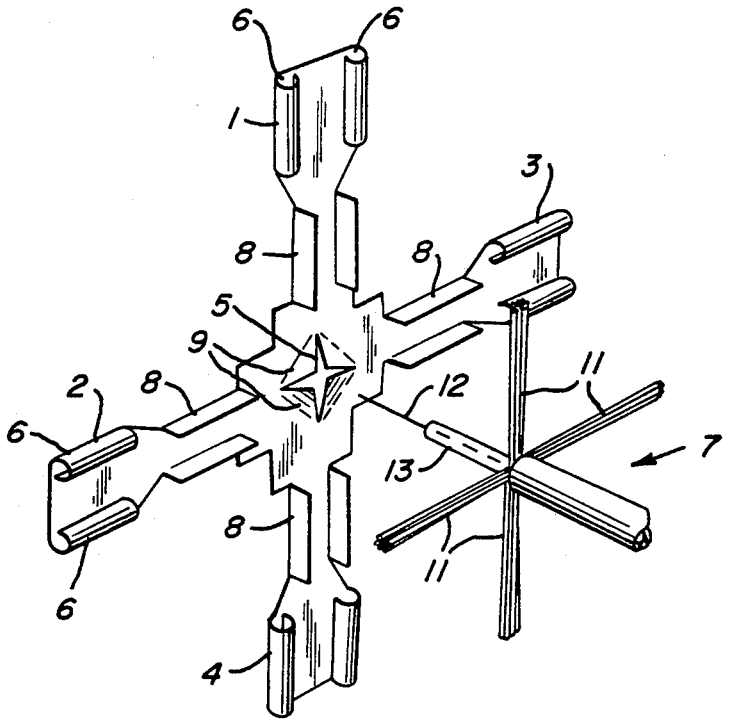
FIG. 1 shows a perspective exploded view of one part of a connector.
Figure 2:
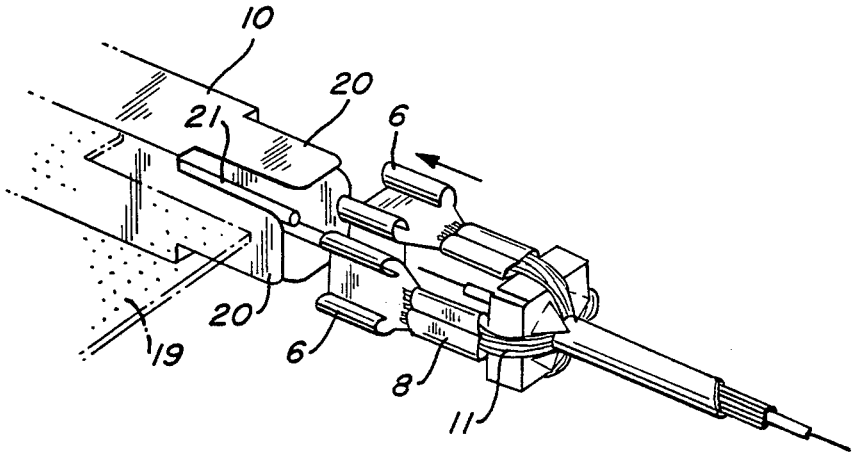
FIG. 2 shows an exploded complete connector.

Referring to FIG. 1, the connector is a stamping of electrically conductive material having four equally spaced branches 1 to 4 and defining a central aperture. Each branch is formed with spring clip portions 6 which are operative to receive spade portions of a complementary connector part 10 (FIG. 2). After being stamped out, a coaxial cable, referenced 7, is specially formed and advanced to the connector. The special forming involves stripping the outer conductor, which consists of a plurality of parallel strands 11 of copper or other electrical conductive material, and grouping them into four groups. As the central conductor 12 with its insulating sheath 13 is pushed through the aperture 5, the four groups 11 are laid into the branches 1 to 4. The wing portions 8, formed in the stamping process on each branch 1 to 4, are folded over to grip the respective groups 11, thus positively connecting the outer conductor to the connector part. The branches are then folded through 90° into a box like shape shown in FIG. 2. Pointed flaps 9 defining the central aperture 5 permit the central conductor 12 with its insulating sheath 13 to pass through the aperture 5 but severely inhibit its withdrawal.

Referring to FIG. 2, the complementary part 10 of the connector may, for example, be the end of an edge connector on a printed circuit board 19. This end is formed with four spade connectors 20 one on each side of a square and in positions to be received into respective branches 1 to 4 of the box formed out of the first mentioned connector part. The four spade connectors surround a central tubular connector 21.

To connect the two connector parts together they are simply pushed into one another so that respective spade connectors are resiliently received by the spring clip portions 6 of the branches 1 to 4, the central conductor 12 simultaneously being received by the tubular connector 21.

The branched connector part of the embodiment of FIG. 1 is, as described, a one piece stamping. It is, however, possible to perform the invention with a connector part which has separate individual branches. Such an arrangement is illustrated in FIG. 3.

Figure 3:
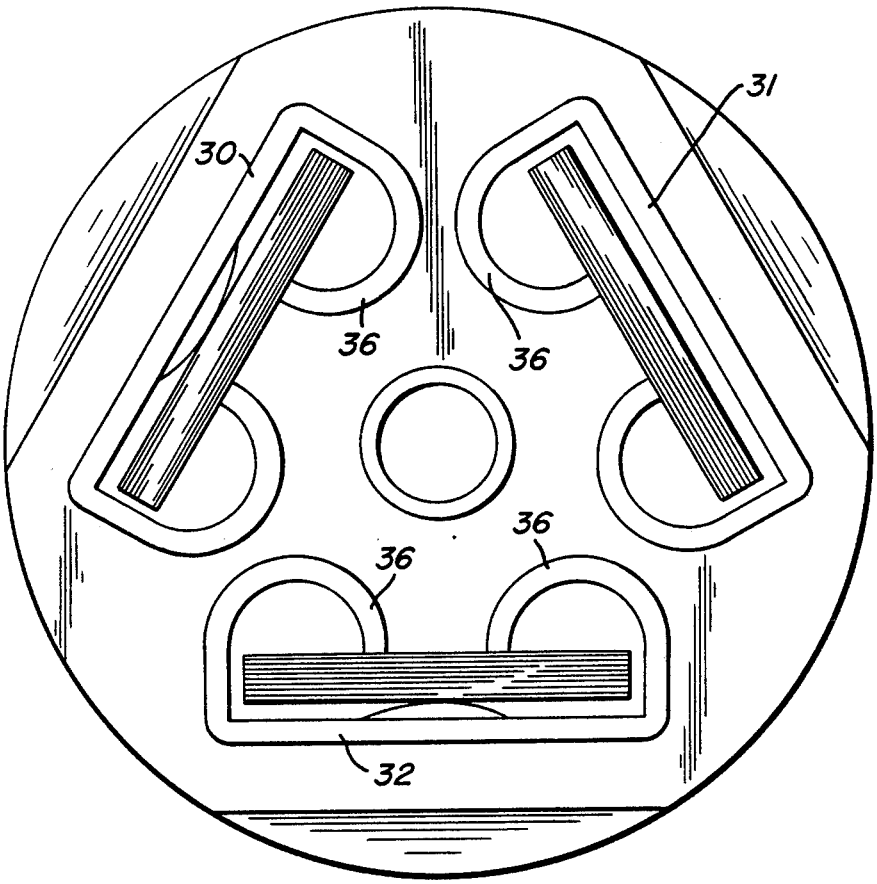
FIG. 3 shows end elevational view of an alternative to the connector parts shown in FIG. 1 but in a different, closed position.

Referring to FIG. 3, three individual connectors 30 to 32 are shown arranged along respective sides of an equilateral triangle. These connectors are coventional and are equivalent to the branches of the connector part shown in FIG. 1. Each connector 30 to 32 therefore has spring clip portions 36 and wings (not shown). In forming the connection, the strands 11 of the outer conductor of the coaxial cable are divided into three groups which are then positively connected to respective connectors 30 to 32 by folding the wings over the strands as described previously. A complementary connector comprising three spade connectors arranged along respective sides of an equlateral triangle is also provided, and the three connectors 30 to 32 are pushed onto these spade connectors while the central conductor 12 of the coaxial cable is pushed into a tubular connector within the triangle of the three spade connectors to complete the connections. This second embodiment has the advantage that parts which are already readily available are used thus decreasing the capital cost necessary to support manufacture.

It will be appreciated that the invention has been described by way of example only and that many variations are possible without departing from the invention. For example, although three and four branch connectors have been specifically described, other numbers of such connectors could equally well be used.

What is claimed is:

1. An electrical connector having mating connector halves for use with a coaxial cable having an outer conductor comprised of a plurality of strands and a central conductor covered with an insulating sheath and surrounded by the outer conductor, wherein one connector half comprises a plurality of first connector parts each adapted to receive and be connected to one of a number of component groups into which the individual conductors of the outer sheath of a coaxial cable are split portions of each of said first connector parts being deformable to grip and positively connect strands of the group to the respective first connector part, the other connector half comprises a plurality of second connector parts complementary to and engageable with the first connector parts, and a connector for the central conductor of the coaxial cable surrounded by said second connector parts.

2. An electrical connector as claimed in claim 1, in which there are three first connector parts and three second connector parts.

3. An electrical connector as claimed in claim 1, in which each of the three and second parts are arranged around the sides of a triangle.

4. An electrical connector as claimed in claim 1, in which each first connector part comprises spring clip portions to receive corresponding second connector parts.

5. An electrical connector as claimed in claim 1, in which each first connector part comprises wings which may, in use, be folded over a corresponding group of conductors.

6. An electrical connector as claimed in claim 1, in which there are four first connector parts and four second connector parts.

7. An electrical connector as claimed in claim 6, in which each of the four first and second parts are arranged around the sides of a square.

8. An electrical connector as claimed in claim 1, in which the first connector parts are formed by a single stamping.

9. An electrical connector as claimed in claim 8, in which the single stamping defines a central aperture through which, in use, the central conductor of the coaxial cable extends.

10. An electrical connector for use with a coaxial cable having an outer conductor formed of a plurality of parallel strands surrounding a central conductor covered with an insulating sheath, the parallel strands being divided into groups of strands, said connector comprising: a plurality of first connector parts for receiving individual ones of the groups of strands and a plurality of complementary shaped second connector parts shaped to mate with respective ones of said first connector parts, each of said first connector parts having:

an end portion connectable to one of the plurality of complementary shaped second connector parts, the second connector parts surrounding a connector for the central conductor of the coaxial cable; and a deformable portion spaced from the end portion for gripping a group of strands, the portion being deformable after placement of the group of strands in the first connector part to thereby encompass and positively grip each strand of the group of strands to thereby positively connect the group of strands to the first connector part.

11. A method of connecting an electrical connector to a coaxial cable having an outer conductor formed of a plurality of parallel strands surrounding a central conductor covered with an insulator, said method comprising:

splitting the strands of the outer conductor into a plurality of individual groups;

positioning each of the groups of strands in a first connector part of the electrical connector;

deforming a portion of each of the first connector parts to encompass and positively grip each of the strands to thereby connect the groups of strands to the first connector parts, the first connector parts being positionable in alignment with an axis of the central conductor so the gripped strands are parallel to the central conductor; and engaging the first connector parts with complementary shaped second connector parts and engaging the central conductor with a connector surrounded by the second connector parts.

12. An electrical connector part for use with a coaxial cable having an outer conductor formed of a plurality of strands surrounding a central conductor covered with an insulating sheath, the strands being divided into individual groups, said connector part comprising:

a body member having a central aperture formed therein for passage of the central conductor; and a plurality of branches extending outwardly from said body member, each of said branches having an outer end portion shaped for engagement with a complementary shaped portion of a second connector part and wing portions intermediate said outer end portion and said body member which may be folded over to securely grip one of said groups of strands to thereby positively connect the individual strands to said branch.

13. A method of connecting a coaxial cable having a sheet comprised of a plurality of parallel extending outer conductors surrounding a central conductor to a connector having a plurality of connector parts which are provided with wing portions comprising the steps of: splitting the outer conductors into a plurality of separate groups, advancing the separate groups to respective ones of the connector parts of the connector, folding said wing portions of said connector parts over each separate group of conductors to positively connect the parts to said groups, and deforming portions of each of the connector parts so that the conductors extend substantially parallel to the central conductor of the cable.

* * * * *